US006189847B1

(12) United States Patent
Hart

(10) Patent No.: US 6,189,847 B1
(45) Date of Patent: Feb. 20, 2001

(54) APPARATUS FOR ATTACHING A WIDE RANGE OF ARTICLE SUPPORTING FIXTURES TO A VARIETY OF SUPPORT SURFACES

(76) Inventor: John Hart, 681 Oakridge Dr., Union, KY (US) 41091

( * ) Notice: Under 35 U.S.C. 154(b), the term of this patent shall be extended for 0 days.

(21) Appl. No.: 09/236,834

(22) Filed: Jan. 25, 1999

(51) Int. Cl.[7] ..... A47B 96/06; A47G 29/00; A47K 1/00; E04G 3/00; E04G 5/06

(52) U.S. Cl. ..... 248/220.31; 248/220.41

(58) Field of Search ..... 248/220.41, 220.42, 248/220.43, 73, 220.21

(56) References Cited

U.S. PATENT DOCUMENTS

| | | | | |
|---|---|---|---|---|
| 1,322,869 | | 11/1919 | Benedict . | |
| 1,366,526 | | 1/1921 | Deragon . | |
| 2,126,630 | | 8/1938 | Gleitsman . | |
| 2,286,118 | * | 6/1942 | Sleeth | 248/58 |
| 2,291,178 | | 7/1942 | Vanderwerp et al. . | |
| 2,489,472 | | 11/1949 | Williams . | |
| 2,743,023 | | 4/1956 | Larson . | |
| 2,954,954 | | 10/1960 | Larson . | |
| 2,980,381 | | 4/1961 | Dectrow . | |
| 3,236,486 | | 2/1966 | Allen . | |
| 3,481,487 | * | 12/1969 | Paruolo | 248/220.41 |
| 3,730,108 | | 5/1973 | Stroh | 108/108 |
| 3,897,926 | * | 8/1975 | Silver | 248/220.22 |
| 3,921,253 | * | 11/1975 | Nelson | 248/300 |
| 4,303,217 | * | 12/1981 | Garfinkle | 248/220.42 |
| 4,340,144 | * | 7/1982 | Cousins | 211/106.01 |
| 4,452,360 | * | 6/1984 | Barnes | 211/59.1 |
| 4,460,147 | | 7/1984 | Macbain | 248/542 |
| 4,502,602 | * | 3/1985 | Swanson | 211/59.1 |
| 4,688,683 | * | 8/1987 | Thalenfeld et al. | 211/57.1 |
| 5,364,051 | * | 11/1994 | Philpot | 248/229.26 |
| 5,397,087 | * | 3/1995 | Teece | 248/220.42 |
| 5,460,279 | | 10/1995 | Emery et al. | 211/106 |
| 5,582,376 | | 12/1996 | Thompson | 248/214 |
| 5,645,175 | | 7/1997 | Wood | 211/57.1 |

OTHER PUBLICATIONS

Acme International Hardware Catalog Acme International, 2 Orange St., Newark, N.J. 07102.

Lee Rowan Hardware Catalog Lee Rowan Co, 9005, Highway Dr., Fenton, Missouri 63026, pp. 52–57.

Global Industrial Eqpt. Catalog—CG2 V2 Global, 1070 Northbrook Parkway, Dept. CG, Suwanee, GA. 30174, pp. 27, 26.

* cited by examiner

*Primary Examiner*—Anita M. King
*Assistant Examiner*—Jerome DeLuca
(74) *Attorney, Agent, or Firm*—O'Connell Law Firm

(57) ABSTRACT

An apparatus for attaching a variety of article supporting fixtures to a variety of support surfaces, having an anterior appendage and two posterior appendages, all three of which being connected by a joining area or joining member, said anterior appendage being of a width at least as great as about the diameter of one of a plurality of wire shelf body wires, and preferably as wide as the space occupied by at least two body wires, said two posterior appendages each being of such a width as to enable them to fit into the space between two adjacent body wires, and likewise being spaced apart from each other on centerlines the distance between which is some multiple of the distance between the body wire center to center distance, said bracket may be positioned at any point and still fit between the body wires of the wire shelf, said posterior appendages being preferably spaced outboard of the anterior appendage, but alternatively arranged otherwise, in a preferred embodiment said posterior appendages each having at least a hole therethrough to facilitate attachment to a support surface, and said anterior appendage having affixed thereto an attachment.

17 Claims, 7 Drawing Sheets

APPARATUS FOR ATTACHING A WIDE RANGE OF ARTICLE SUPPORTING FIXTURES TO A VARIETY OF SUPPORT SURFACES

BACKGROUND OF THE INVENTION

This invention relates generally to the field of support brackets, and more particularly to an apparatus for attaching a wide range of items including article supporting fixtures to a variety of support surfaces.

SUMMARY OF THE INVENTION

An apparatus for attaching a wide range of items including article supporting fixtures to a variety of support surfaces such as a wire shelf, pegboard, conventional wall, grid wall, slatwall, etc, has an anterior appendage and at least two posterior appendages, all three of which are connected by a joining area or joining member. The anterior appendage is of a width at least as great as about the diameter of one of a plurality of wire shelf body wires which make up the surface of the shelf, and preferably as wide as the space occupied by at least two body wires. The at least two posterior appendages are each of such a width as to enable them to fit into the space between two adjacent body wires, and are likewise spaced apart from each other on centerlines the distance between which is some multiple of the distance between the body wire center to center distance. In this manner, the bracket may be positioned at any point and still fit between the body wires of the wire shelf. The posterior appendages are preferably spaced outboard of the anterior appendage, but may be otherwise arranged, and indeed may be spaced apart a considerable distance. Said posterior appendages each have at least an orifice therethrough to facilitate attachment to a support surface, and said anterior appendage has affixed thereto an attachment. Alternatively, said anterior appendage makes use of a keyhole slot for securing an attachment thereto. Again, an alternative use reverses the apparatus to further enhance versatility as will be described.

The primary object of the invention is to provide a better bracket that can be attached to a wider variety of surfaces.

Another object of the invention is to provide a device that mounts attachments to wire shelving, as well as other surfaces.

Yet another object of the invention is to provide an apparatus that can accommodate a wider variety of attachments.

Still another object of the invention is to provide a device can hold a larger variety of articles.

A further object of the invention is to provide a support bracket, which can equally well support a hook, strap, basket, or shelf, etc.

Yet still another object of the invention is to provide an attachment support bracket, which can be inverted and used as a wire shelf support.

Another object of the invention is to provide an attachment support bracket, which can be inverted and used as a pegboard support.

Another object of the invention is to provide a device that is easily attached.

Yet another object of the invention is to provide an apparatus which is not easily dislodged, but can be made easily removable.

Another object is to provide an apparatus, which may be attached securely.

Still another object is to provide an apparatus, which has shock absorbing capabilities.

Yet another object of the invention is to provide a device that is easily manufactured.

Other objects and advantages of the present invention will become apparent from the following descriptions, taken in connection with the accompanying drawings, wherein, by way of illustration and example, an embodiment of the present invention is disclosed.

DESCRIPTION OF RELATED ART

Many ways have been devised to hang up articles, whether it be from walls, pegs, or racks, and whether the articles are loose items, articles of clothing, round, regular, or irregular in shape. Of particular interest are the domestic closet, the garage, basement or pantry wall, and the store display. In each of these areas it is desirable to make maximum use of the allotted space, while maximizing visibility, exposure, and access for each individual item or class of item. It is also desirable to maximize flexibility in the layout, so that the area may be easily rearranged.

Past attempts to satisfy this need have involved various solutions such as shelving, baskets, movable shelf supports, pegboard and the like, and each has in turn improved the art. The use of baskets of various types added flexibility to the basic shelf. Movable brackets allowed differing sizes of articles to be placed within the same storage system. Wire shelving provided a number of benefits including ease of cleaning, light weight, and the ability to support a substantial load. Pegboard introduced a new level in versatility and layout. Slotted panels combined some of the versatility of pegboard with an enhanced marketing appearance, and so on.

Throughout this time there have always been challenges which seemed to defy all efforts to produce the ideal solution. Such challenges are often daunting as much from their apparent simplicity, as from their technical requirements, and often a solution has taken more the form of recognizing a problem existed to be solved, than actually creating a solution. A good example of such might be a broom holder, which will work with all sizes of broom handles and can be operated with only one hand.

Wire shelving has achieved the status of a commodity item in new residential construction and remodeling, as well as in many commercial applications. Typically employed as closet shelving and for utility areas, it has numerous advantages including high strength, light weight, is relatively self-cleaning, easily adaptable, etc. Such shelving is commonly available from home goods suppliers such as Home Quarters, Lowes, and most hardware stores. With increasing popularity a number of accessory items have become available as well, such as corner pieces, and various hanging attachments. In the typical wire shelf, a number of support rods run the length of the shelf and are overlaid by a plurality of relatively smaller diameter body wires which form the shelf surface. Often the shelf has an additional support rod placed directly below the forwardmost support rod, and the body wires form a 90° bend around the top support rod, in this way forming a front surface for the shelf and stiffening the shelf as well. In the typical installation of wire shelving and accessories, small plastic hooks or brackets are attached to a wall, usually with screws or nails, along a line where the shelf is to be mounted. Then the shelf or accessory is placed in the hooks, and snapped into place. This results in a small unobjectionable gap between the rear support wire and the wall, usually on the order of ⅛ to 3⁄16 inch or so. The inventor's device can take advantage of this gap, as will be shown.

A number of so called "clip-on" accessories have been designed to attach to the front support rod, but it was the intent of the inventor that the device have greater adaptability than was seen with these devices, and provision was also made for the use of the bracket with pegboard. Support structures other than pegboard and wire shelving also exist, and so the inventor made provision for universal attachment to a wide variety of surfaces using common attachment methods such as adhesive, screws, expanding anchors, nails, two sided tape, and the like.

A need likewise existed for a versatile and strong bracket for attaching wire shelving and pegboard to support structures, and the inventor's device fills that need admirably. Also there was a need for a strong and durable bracket with a degree of flexibility to provide a shock absorbing function which was adaptable to a multiplicity of uses, and the instant device provides a ready answer.

DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. Phantom lines are used where applicable to denote the existence of related structure not cored a part of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
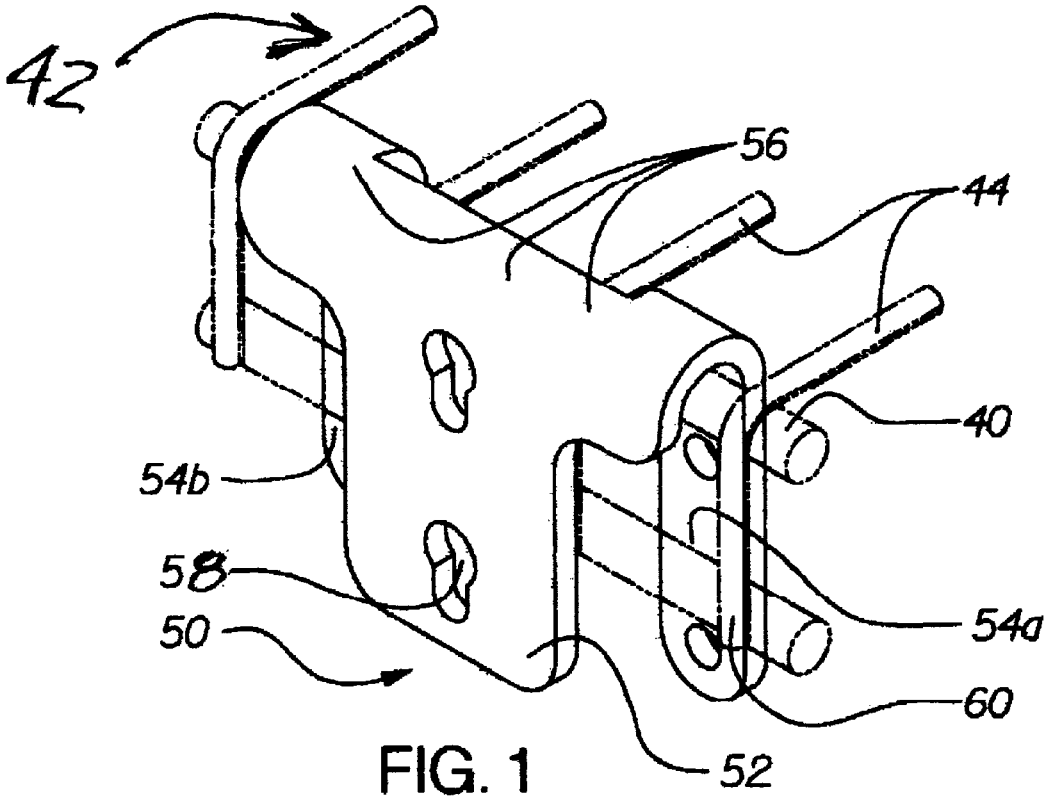
FIG. 1 is a perspective view of the invention showing the operative features thereof.
Figure 2:
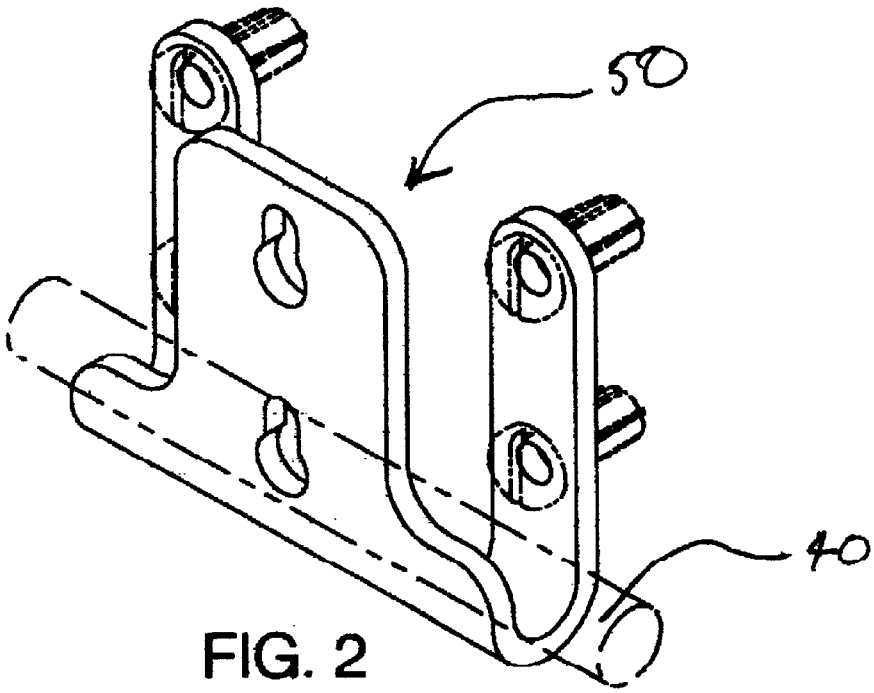
FIG. 2 is an inverted perspective view of the invention showing the operative feature thereof.

FIGS. 1 and 2 depict a preferred embodiment of the invention in 180° orientations relative to each other. In FIG. 1, which shows the normal orientation, the invention is placed in position over the forwardmost top support rod 40 of a wire shelf 42 which is shown in phantom lines. A plurality of body wires 44 make up the body of the shelf 42.

A bracket 50 in FIG. 1, has an anterior appendage 52 and at least two posterior appendages 54*a* and 54*b,* all three of which are connected by a joining area or joining member 56. The anterior appendage 52 is of a width at least as great as about the diameter of one of the body wires 44, and preferably as wide as the space occupied by at least two body wires 44. The two posterior appendages 54*a, b* are each of such a width as to enable them to fit into the space between two adjacent body wires 44, and are likewise spaced apart from each other on centerlines the distance between which is some multiple of the distance between the body wire 44 center to center distance. In this manner, the bracket 50 may be positioned at any point and still fit between the body wires 44. The posterior appendages 54*a, b* are preferably spaced outboard of the anterior appendage 52, but may be otherwise arranged as will be described later.

Figure 3:
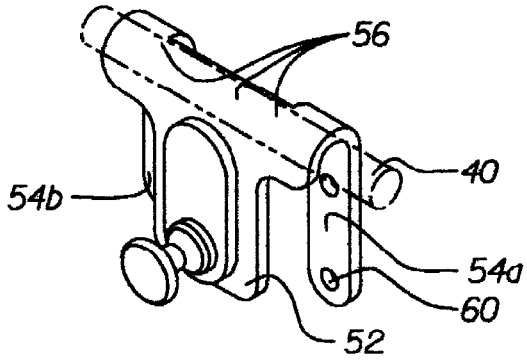
FIG. 3 is a perspective view of the invention showing an alternate embodiment thereof.
Figure 4:
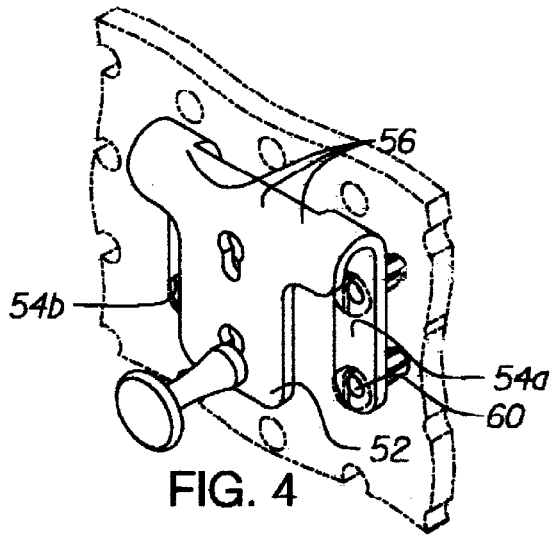
FIG. 4 is a perspective view of the invention showing an alternate embodiment thereof.
Figure 5:
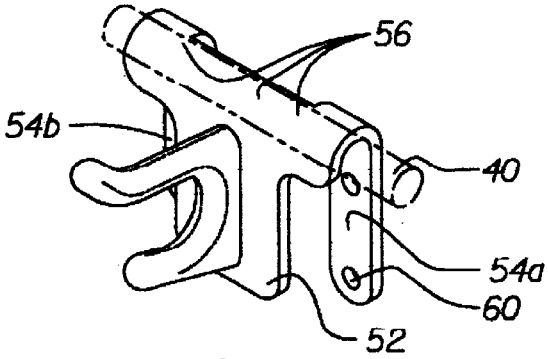
FIG. 5 is a perspective view of the invention showing an alternate embodiment thereof.
Figure 6:
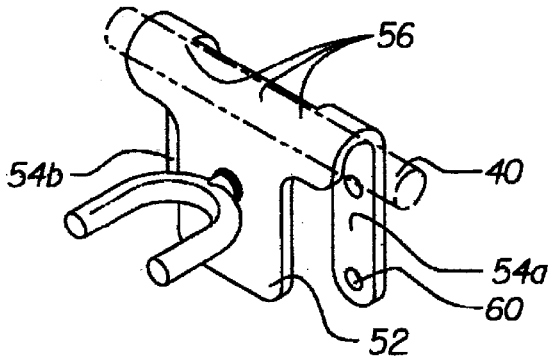
FIG. 6 is a perspective view of the invention showing an alternate embodiment thereof.
Figure 7:
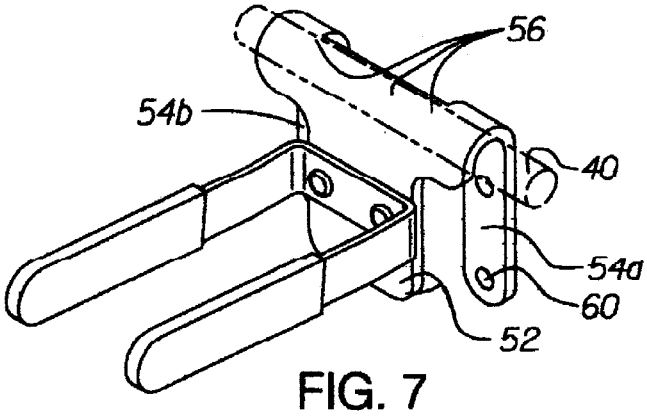
FIG. 7 is a perspective view of the invention showing an alternate embodiment thereof.
Figure 8:
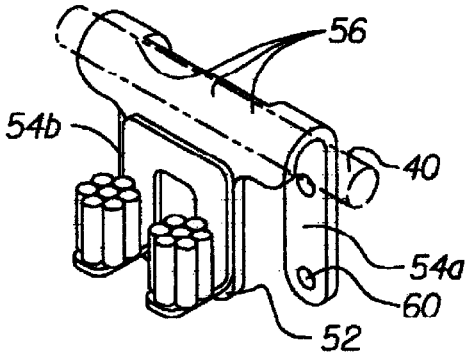
FIG. 8 is a perspective view of the invention showing an alternate embodiment thereof.
Figure 9:
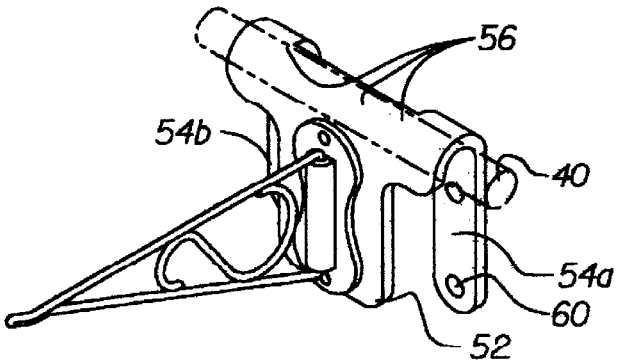
FIG. 9 is a perspective view of the invention showing an alternate embodiment thereof.
Figure 10:
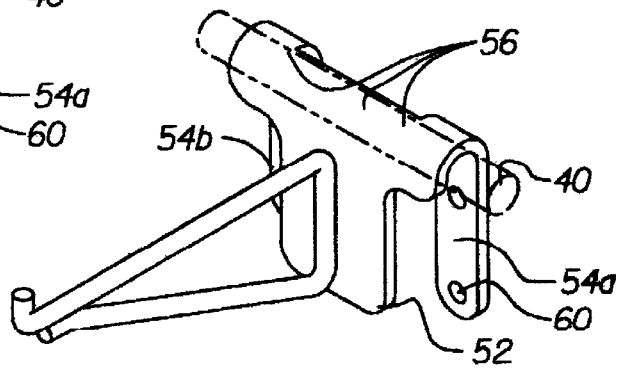
FIG. 10 is a perspective view of the invention showing an alternate embodiment thereof.
Figure 11:
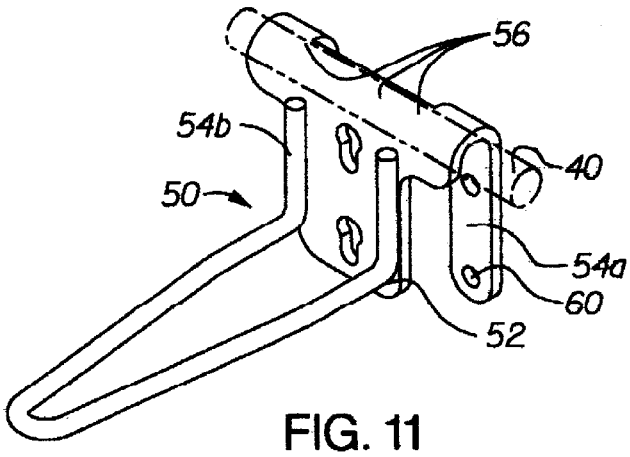
FIG. 11 is a perspective view of the invention showing an alternate embodiment thereof.
Figure 12:
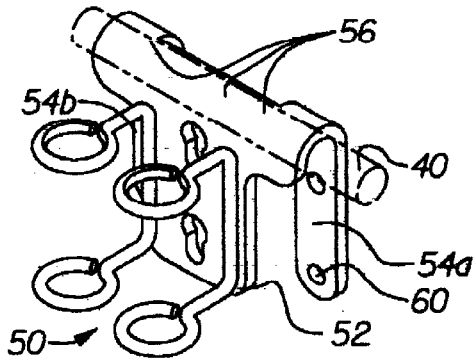
FIG. 12 is a perspective view of the invention showing an alternate embodiment thereof.
Figure 13:
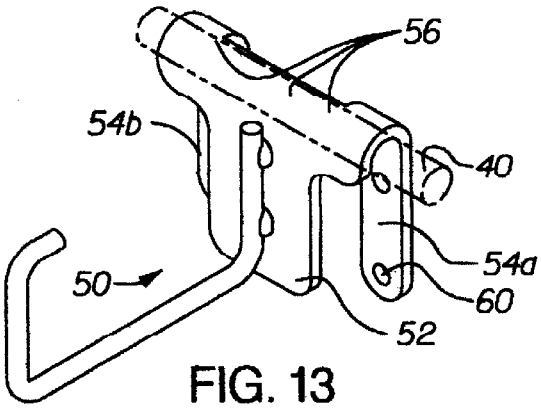
FIG. 13 is a perspective view of the invention showing an alternate embodiment thereof.
Figure 14:
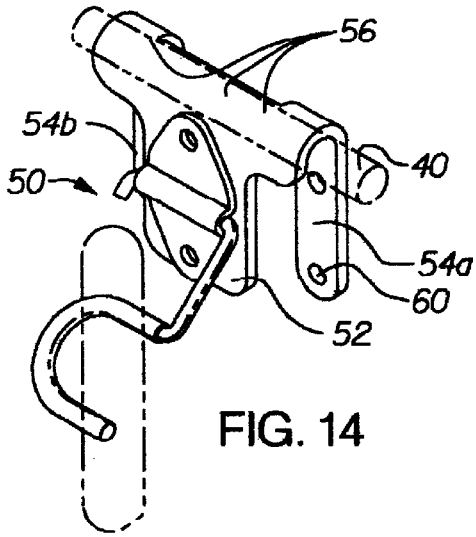
FIG. 14 is a perspective view of the invention showing an alternate embodiment thereof.
Figure 15:
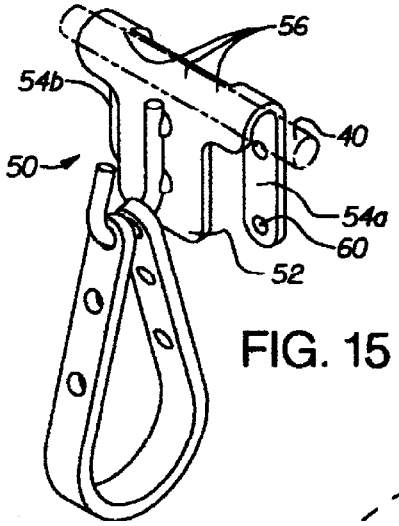
FIG. 15 is a perspective view of the invention showing an alternate embodiment thereof.
Figure 17:
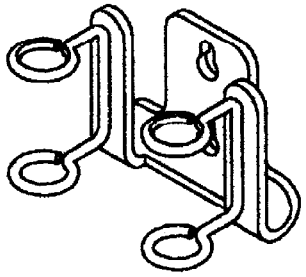
FIG. 17 is a perspective view of the invention showing an alternate embodiment thereof.
Figure 16:
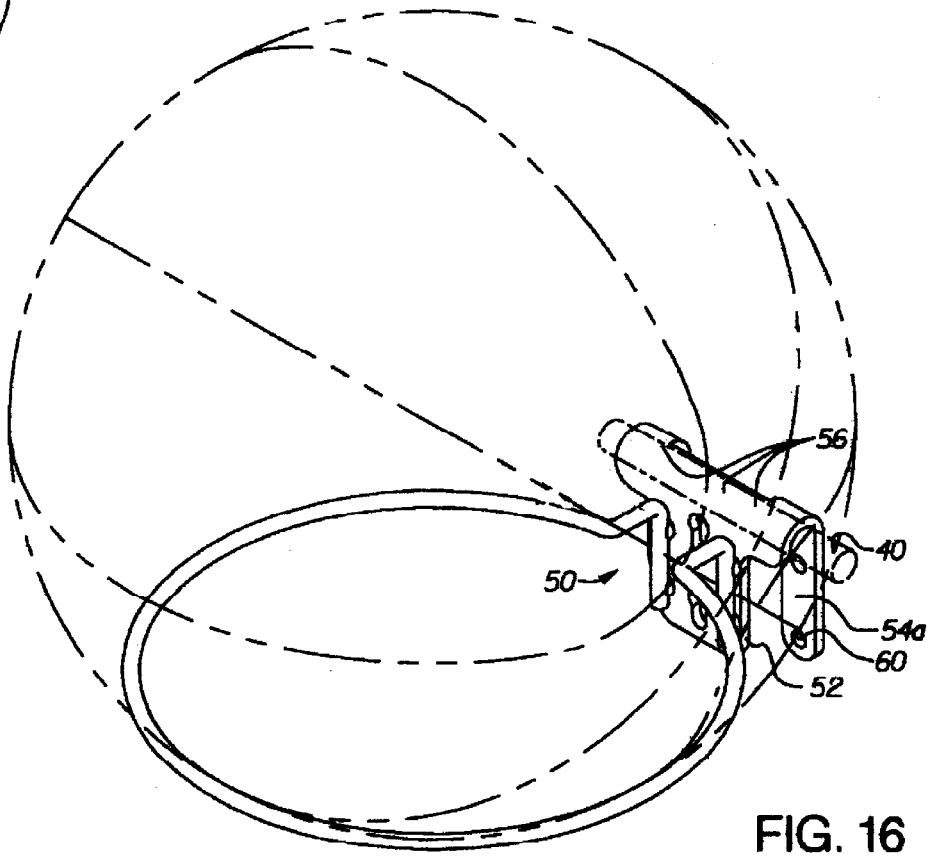
FIG. 16 is a perspective view of the invention showing an alternate embodiment thereof.
Figure 18:
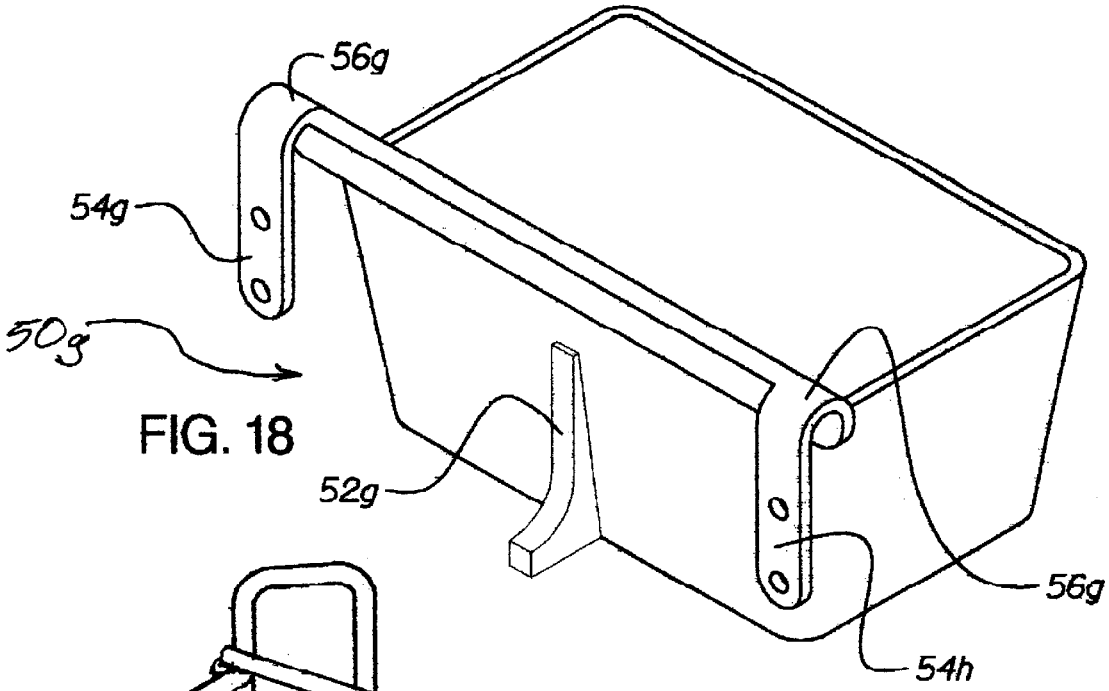
FIG. 18 is a perspective view of the invention showing an alternate embodiment thereof.
Figure 19:
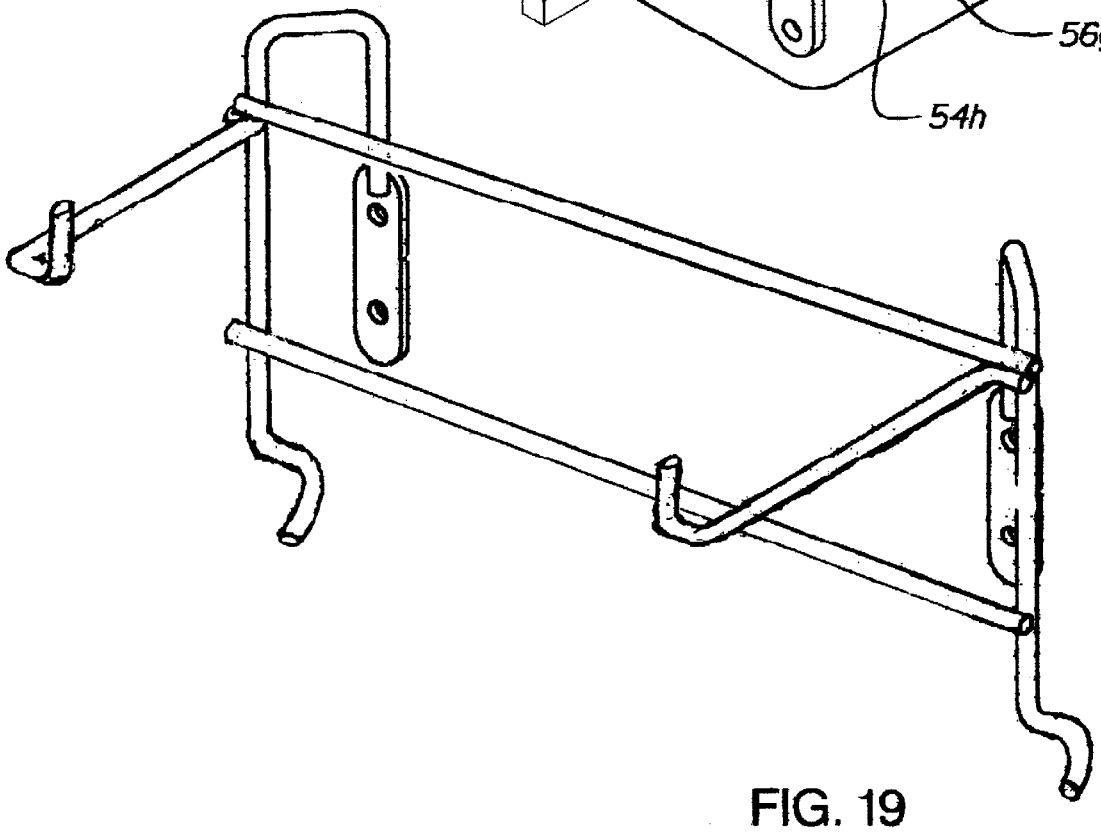
FIG. 19 is a perspective view of the invention showing an alternate embodiment thereof.
Figure 20:
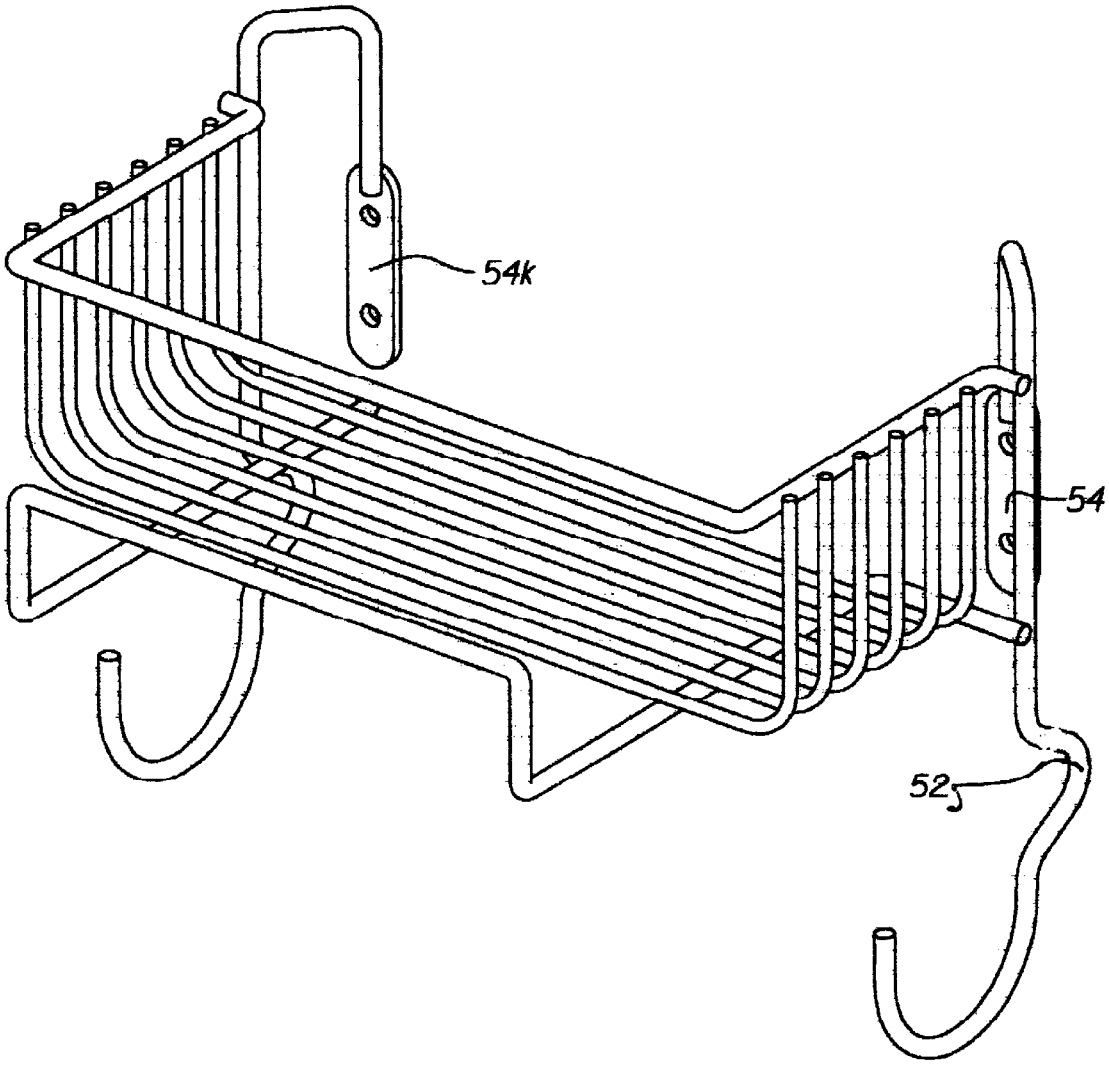
FIG. 20 is a perspective view of the invention showing an alternate embodiment thereof.

In use the bracket 50 is positioned astride the top front support rod 40 with the posterior appendages projecting into the spaces between the body wires 44 behind the support rod 40, and the bracket 50 is then pressed down until the joining member 56 contacts the body wires 44 of the wire shelf. The anterior appendage rests against one or more of the body wires and/or the lower front support rod. Located thusly the bottom of the anterior and top of the posterior appendages resist downward tipping of the bracket and attachment, serving to urge the center part of the shelf upwards in the process, thereby assisting in supporting loads on the shelf as well. The anterior appendage 52 has therethrough one or more keyhole slots 58 so that various attachments may be secured thereto. These attachments may take a wide variety of shapes and forms many of which are common in the prior art and in industry and include but are not limited to the following: a hat peg as shown in FIG. 3, shaker peg as shown in FIG. 4, coat hook as shown in FIG. 5, implement or hammer hook as shown in FIG. 6, shovel hook or broom hook as shown in FIGS. 7 and 8 and 14, garment hook as shown in FIGS. 9 and 10, general purpose hook as shown in FIG. 11, screwdriver loops as shown in FIGS. 12 and 17, bicycle (large) hook as shown in FIG. 13, water hose hook, vacuum cleaner hose hook, vacuum cleaner hose accessory basket as shown in FIG. 20, belt rack, tie rack, shoe rack, janitorial supply rack, Christmas wrapping paper roll hooks, hanging basket as shown in FIG. 18, plastic grocery bag hooks as shown in FIG. 19, strap hook as shown in FIG. 15, basketball loop as shown in FIG. 16, merchandise hooks, pegboard hooks, and so on. These attachments may likewise be constructed as an inseparable part of the bracket 50 as shown in a number of the alternate embodiments, such as FIGS. 6, 10, 12, 13, 15, and 16, and other attachment methods such as rivets may be employed as well as shown in FIG. 7. Additionally the keyhole slots 58 can be used as attachment slots for supporting the bracket 50 as later described herein. The posterior appendages have therein one or more apertures or holes 60 which may be used for attaching the bracket 50 to a wide variety of surfaces such as any conventional wall or to pegboard.

Although unique in respect to wire shelving, the bracket is just as suitable to other mounting surfaces and uses, and may be used to support other items such as wire shelves, pegboard, and the like. It is suitable for use on plaster walls, with the appropriate and conventional fasteners commonly available such as screws, expanding anchors of various types, nails, adhesives, double sided adhesive tape, etc., and indeed may be used on practically any type of surface. For example, it is readily used as a high strength support for the aforementioned wire shelving and related items, utilizing the aforementioned gap between the shelving and the wall. In this case the bracket is inverted as shown in FIG. 2 and the screws and expanding anchors shown in phantom lines are not used. Rotating the bracket 180° about the vertical axis from the orientation as shown, the anterior member is positioned between the support rod and the wall. After positioning the bracket upwards a fastener can be used in one or more keyhole slot 58 to attach the bracket securely to the wall, or the fasteners may be positioned at intervals along a line, the brackets positioned thereon, and the shelf slid into the brackets. Should even greater holding power be desired, fasteners may be attached at this point through one or more of the apertures or holes 60 in the posterior appendages, and likewise secured to the wall. The brackets may be used for wooden shelving as well, by attaching the posterior appendages to the edge of the shelf and then using the keyhole slots 58 to slip the brackets over previously located fasteners on a suitable support surface. The use of fasteners in the holes 60 when the posterior members of the bracket are attached directly to a support surface is greatly facilitated by the offset of the posterior members from the anterior members, thereby allowing space to get a screwdriver or other tool into close enough proximity to tighten the fastener.

In FIG. 2 the bracket is shown inverted, to illustrate its applicability to a use as a shelf support as opposed to or in conjunction with its use as an article support bracket. In this case two modes of use are readily apparent. The keyhole slots may be used to engage one or more fasteners such as screws or nails anchored in a support structure such as a wall or display rack. A surface having projecting buttons at regular intervals used in conjunction with the bracket 50 could be used to create a display system having great versatility, as the brackets could be easily removed and repositioned, and would be mounted securely when in place. The support rod 40 of a wire shelf or basket can then be supported by the bracket as previously described, or the bracket could be used to support small merchandise racks. In this application the two posterior appendages would serve to double the density of the display since there are twice the number of projections to attach to.

Also, by rotating the bracket as shown in FIG. 1 180° around the vertical axis and using the mounting holes 60 to provide a means of mounting the bracket, increased security can be achieved, should it be desired, since the fasteners would have to be removed to remove the bracket. This might be particularly applicable for use with attachments which can readily use a single point of attachment, and which are subject to considerable forces at odd angles, such as for example, a coat hook as shown in FIG. 5. Also, the bracket can be inverted relative to the attachment for increased hanging capacity. Here, the connecting member is used to support hangers and the like. It can also be engineered to perform the additional function of a shock absorber by varying the dimensions and material choices to achieve the desired characteristics. In this case, the joining member is designed to be deformable upon the application of stress, and will return to the initial shape upon the release of that stress. This shock absorbing use is available in either orientation of the bracket.

Additionally, the bracket is adaptable to pegboard systems, both as an article hanger bracket, and as a means of hanging the pegboard itself. Spacing of the keyhole slots 58 and of the mounting holes 60 is easily matched to the hole centers of the pegboard and attachment to the pegboard is easily accomplished with standard pan-head screws and truncated plastic expanding anchors as shown in FIG. 4, which can be made by cutting the ends off of standard expanding anchors, or by modification of the production molds. In this way at least three goals are accomplished. Attaching the brackets in the orientation shown in FIG. 2 to the backside of the pegboard using the holes 60 provides a simple, effective, and easy to use hanger bracket for the pegboard itself, utilizing the keyhole slots to make hanging of the assembled pegboard a matter of just slipping the keyholes over the protruding heads of properly placed fasteners. Attaching the bracket 50 in the same manner to the front side of the pegboard provides a support bracket for wire baskets and similar wire shelving and accessories. Attaching it in the normal orientation as shown in FIG. 1 allows its use with any of the attachments previously enumerated, and pegboard hooks may be used in the keyhole slots as well.

If turned around from the orientation shown in FIG. 2 the bracket 50 may be supported from the pegboard by the keyhole slots, providing benefits similar to those of the surface having projecting buttons described above, and in fact this type of use is suitable to any surface where the use of one bracket in multiple locations is foreseen. In this case the bracket is easily moved to alternate locations.

In FIG. 18 is shown an alternate embodiment in which the bracket is integrated into the body of the attachment itself, which is in this case a basket. As can be seen, the bracket 50*g* has been widened, yet the anterior member 52*g* has been narrowed. As before, the posterior members 54*g,* hare positioned outboard of the anterior member 52*g* and are likewise outboard of the body of the basket itself as shown.

FIG. 19 shows an alternate embodiment in which a provision is made for a pair of hooks that can be used to support the handles of a common plastic grocery bag.

In the alternate embodiment shown in FIG. 20, again the construction is unitary. However, a wire construction is used, and the body of the attachment is organized such that it is possible for the posterior members 54*j, k* to be located inboard of two or more anterior members 52*j*. It should be readily apparent that other arrangement of a similar nature would serve the same purpose. Clearly, all alternate embodiments can not be shown, but the present examples should serve to convey the concept of the variety that is readily foreseeable.

As one will appreciate from the figures, the first posterior appendage 54*a* has a central portion that is spaced a given distance from a central portion of the second posterior appendage 54*b*. It is also clear that the preferred bracket 50 is calibrated for attachment to a wire structure such as the wire shelf 42 that has a plurality of adjacent body wires 44. The bracket 50 defines a U-shaped profile wherein the joining member 56 forms a base of the U, the first and second posterior appendages 54*a, b* form a first leg of the U, and the anterior appendage 52 forms a second leg of the U. Each of the body wires 44 is spaced a given center-to-center distance from an adjacent body wire 44. In a standard wire shelf 42, this center-to-center distance may be approximately one-half inch, but is most commonly approximately one inch. In such embodiments, each of the first and second posterior appendages 54*a, b* should have a width less than the distance between adjacent body wires 44 of the wire shelf 42 such that each of the first and second posterior appendages 54*a, b* can be received between adjacent body wires 44 of the wire shelf 42. Accordingly, where the adjacent body wires 44 are spaced at one-inch center-to-center distances, a preferred bracket 50 will have first and second posterior appendages 54*a, b* that are less than one inch wide minus the diameter of one body wire 44, which diameter typically varies between approximately 0.1 inches and 0.3 inches. Where the adjacent body wires 44 are spaced at one-half-inch center-to-center distances, a preferred bracket 50 wilt have first and second posterior appendages 54*a, b* that are less than one-half inch wide minus the diameter of one body wire 44.

The inventor has further discovered that, for the bracket 50 to be most easily employed as indicated in FIG. 1, for example, the distance between the central portions of the first and second posterior appendages 54*a, b* should be a multiple of the center-to-center distance between adjacent body wires 44 so that the bracket 50 can be coupled to a wire shelf 42 (as FIG. 1 shows) with the first and second posterior appendages 54*a, b* each received between a pair of adjacent body wires 44 of the wire shelf 42. Accordingly, where the adjacent body wires 44 of the wire shelf 42 are spaced with a center-to-center distance of approximately one-half inch, the distance between the central portions of the first and second posterior appendages 54*a, b* should be any multiple of one-half inch (i.e., 0.5 inches, 1 inch, 2.5 inches, 6 inches, or the like). Similarly, where the adjacent body wires 44 of the wire shelf 42 are spaced with a center-to-center distance of approximately one inch, the distance between the central portions of the first and second posterior appendages 54*a, b* should be any multiple of one inch (i.e., 1 inch, 2 inches, 6 inches, 10 inches, or the like).

Where the bracket 50 is further or alternatively designed for attachment to a pegboard structure as FIG. 4 shows, it is preferred that the mounting holes or apertures 60 in the first and second posterior appendages 54*a, b* be calibrated to align with the apertures in standard pegboard. Advantageously, the invention exploits the fact that pegboard provides an array of evenly spaced apertures disposed in aligned columns and rows. In standard pegboard, adjacent rows and columns are spaced with the centers of their respective apertures approximately one inch apart. Accordingly, in the preferred bracket 50, the mounting hole 60 in the first posterior appendage 54*a* is spaced any multiple of one inch (i.e., 1 inch, 3 inches, 7 inches, 12 inches, or the like) away from the mounting hole 60 in the second posterior appendage 54*b*.

With this, the mounting holes 60 readily align with apertures in standard pegboard to allow ready mounting of the bracket 50 to the pegboard for a wide variety of purposes including acting as a means for mounting an item such as a wire shelf 42 to the pegboard or acting as a means for supporting an article on the pegboard as by the addition of a support structure to the bracket 50 such as any of those shown herein. As was described above, the means for supporting an article by the bracket 50 may comprise a variety of projections coupled to the anterior appendage 52 or to either or both of the first and second posterior appendages 54*a, b*. Again, although the bracket 50 could be attached to a support surface by screws, anchors, or the like, other means for attaching the apparatus to a support surface could be readily employed such as adhesive or double-sided tape for being interposed between the apparatus and the support surface.

From the foregoing, it will be clear that the inventor has created an improved bracket 50 that is usable in a number of orientations with a variety of support surfaces to support a multiplicity of articles. The bracket 50 is easily mountable and in certain dispositions can provide security of mounting not achievable in other mounting devices. Advantageously, the bracket 50 provides these advantages while employing common and readily available mounting fasteners and methods. In preferred embodiments, at least a portion of the bracket 50 is formed from a resiliently deformable material that provides shock absorbing tendencies to reduce damage to the bracket 50 itself and the items and support surfaces with which it is associated. Furthermore, the bracket 50 can provide permanent or temporary attachment to support surfaces, to means for supporting an article, and to various items. Undoubtedly, those who review this disclosure and those who have an opportunity to take advantage of an embodiment of the present invention will be readily aware of still further advantages deriving from the unique bracket 50.

It will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. A bracket for attaching a wide range of items to a variety of support surfaces, the bracket comprising:

a bracket body comprising a joining member, an anterior appendage coupled to the joining member, a first posterior appendage coupled to the joining member, and a second posterior appendage coupled to the joining member wherein the first posterior appendage has a central portion spaced a given distance from a central portion of the second posterior appendage;

wherein the joining member, the anterior appendage, and the first and second posterior appendages together define a U-shaped profile wherein the joining member forms a curved base of the U, the first and second posterior appendages comprise separate, elongate, and flat finger-shaped members and form a first leg of the U, and the anterior appendage is flat and forms a second leg of the U whereby the bracket body can straddle an elongate member of an external structure with the joining member disposed against the elongate member of the external structure and the anterior appendage and the first and second posterior appendages disposed on opposite sides of the elongate member of the external structure;

wherein each of the first and second posterior appendages has at least one aperture through the central portion thereof for facilitating attachment relative to the bracket body;

wherein the anterior appendage has an aperture therethrough for facilitating attachment relative to the bracket body; and wherein the first and second posterior appendages and the apertures thereof are disposed outboard of the anterior appendage and the aperture thereof.

2. The bracket of claim 1 wherein the apparatus is calibrated for attachment to a wire structure that has a plurality of adjacent body wires with each of the wires spaced a given center-to-center distance from an adjacent body wire wherein each of the first and second posterior appendages has a width less than the distance between adjacent body wires of the wire structure whereby each of the first and second posterior appendages can be received between adjacent body wires of the wire structure.

3. The bracket of claim 2 wherein the distance between the central portions of the first and second posterior appendages is a multiple of the center-to-center distance between adjacent body wires whereby the apparatus can be coupled to a wire structure with the first and second posterior appendages each received between a pair of adjacent body wires of the wire structure.

4. The bracket of claim 3 wherein the bracket is calibrated for attachment to a wire structure that has a plurality of adjacent body wires with each of the wires spaced a center-to-center distance of approximately one inch from an adjacent body wire wherein each of the first and second posterior appendages has a width less than approximately one inch and wherein the distance between the central portions of the first and second posterior appendages is an approximate multiple of one inch whereby the bracket can be coupled to a wire structure with the first and second posterior appendages each received between a pair of adjacent body wires of the wire structure.

5. The bracket of claim 3 wherein the bracket is calibrated for attachment to a wire structure that has a plurality of adjacent body wires with each of the wires spaced a center-to-center distance of approximately one-half inch from an adjacent body wire wherein each of the first and second posterior appendages has a width less than approximately one-half inch and wherein the distance between the central portions of the first and second posterior appendages is an approximate multiple of one-half inch whereby the bracket can be coupled to a wire structure with the first and second posterior appendages each received between a pair of adjacent body wires of the wire structure.

6. The bracket of claim 1 wherein the bracket is calibrated for attachment to pegboard that has a plurality of apertures spaced apart at a center-to-center distance of approximately one inch wherein the distance between the central portions of the first and second appendages is an approximate multiple of one inch whereby the bracket can be attached to a pegboard with the at least one aperture in each of the first and second posterior appendages aligned with an aperture in the pegboard.

7. The bracket of claim 1 wherein the aperture in the anterior appendage is keyhole-shaped.

8. The bracket of claim 1 further comprising a means for attaching the bracket to a support surface.

9. The bracket of claim 8 wherein the means for attaching the bracket to a support surface comprises adhesive for being interposed between the bracket body and the support surface.

10. The bracket of claim 8 wherein the means for attaching the bracket to a support surface comprises double-sided tape for being interposed between the bracket body and the support surface.

11. The bracket of claim 1 wherein at least a portion of the body of the bracket is formed from resiliently deformable material whereby the bracket can absorb shock.

12. The bracket of claim 1 further comprising an item coupled to the bracket body for being attached to a support surface.

13. The bracket of claim 12 wherein the item is permanently fixed to the bracket body.

14. The bracket of claim 12 wherein the item is removably coupled to the bracket body.

15. The bracket of claim 1 further comprising a means for supporting an article by the bracket by a fastening to at least one of the apertures in the anterior appendage or the first and second posterior appendages.

16. The bracket of claim 15 wherein the means for supporting an article by the bracket comprises a projection coupled to the anterior appendage.

17. The bracket of claim 15 wherein the means for supporting an article by the bracket comprises a projection coupled to at least one of the first and second posterior appendages.

* * * * *